US008231272B2

(12) United States Patent
Goglio et al.

(10) Patent No.: US 8,231,272 B2
(45) Date of Patent: Jul. 31, 2012

(54) STAND-UP, EASY-OPEN AND EASY-CLOSE PACKAGE OF FLEXIBLE MATERIAL, PARTICULARLY FOR LIQUID, VISCOUS, PASTY, GRANULAR OR POWDERED PRODUCTS

(75) Inventors: Franco Goglio, Milan (IT); Giorgio Bottini, Gallarate (IT)

(73) Assignee: Goglio S.p.A., Milan (IT)

( * ) Notice: Subject to any disclaimer, the term of this patent is extended or adjusted under 35 U.S.C. 154(b) by 999 days.

(21) Appl. No.: 12/173,035

(22) Filed: Jul. 15, 2008

(65) Prior Publication Data

US 2009/0022433 A1 Jan. 22, 2009

(30) Foreign Application Priority Data

Jul. 20, 2007 (EP) ..... 07425446

(51) Int. Cl.
*B65D 30/16* (2006.01)
*B65D 33/00* (2006.01)

(52) U.S. Cl. ..... 383/104; 383/211; 383/210

(58) Field of Classification Search ..... 383/78, 383/104, 211, 207; 229/160.2; 222/572, 222/574

See application file for complete search history.

(56) References Cited

U.S. PATENT DOCUMENTS

| | | | | |
|---|---|---|---|---|
| 3,036,756 A | | 5/1962 | Lieschke | |
| 3,380,646 A | * | 4/1968 | Doyen et al. | 383/104 |
| 3,738,566 A | | 6/1973 | Foster | |
| 4,936,456 A | * | 6/1990 | Bell et al. | 206/439 |
| 5,392,589 A | * | 2/1995 | Buchanan | 53/412 |
| 2005/0041890 A1 | * | 2/2005 | Tan | 206/554 |
| 2005/0241976 A1 | | 11/2005 | Britto et al. | |

FOREIGN PATENT DOCUMENTS

| | | |
|---|---|---|
| EP | 0541093 | 5/1993 |
| GB | 1561817 | 3/1980 |
| JP | 2000118536 | 4/2000 |

OTHER PUBLICATIONS

CN Office Action dated May 11, 2010 in corresponding 200810133656.5.

European search report in corresponding EP 07425446.

* cited by examiner

*Primary Examiner* — Nathan J Newhouse

*Assistant Examiner* — Matthew Theis

(74) *Attorney, Agent, or Firm* — Young & Thompson

(57) ABSTRACT

A package made of a flexible material for containing liquid, viscous, pasty, granular or powdered products has a supporting base from which rise two opposite side walls joined to the perimeter of the base and joined to each other along the side edges. Each side wall includes an upper flap joined thereto by a fold line. The package also includes a top wall joined peripherally to the upper flaps of the sidewalls and a peelable closure in at least one portion of the perimeter of the top wall joined to the upper flaps of the sidewalls. The peelable closure is destined to be opened so as to form an opening for discharging the product. On the top wall there are provided gripping elements adapted to be gripped and raised by the user so as to cause the separation of the peelable closure to create the opening for discharging the product.

13 Claims, 7 Drawing Sheets

FIG. 3
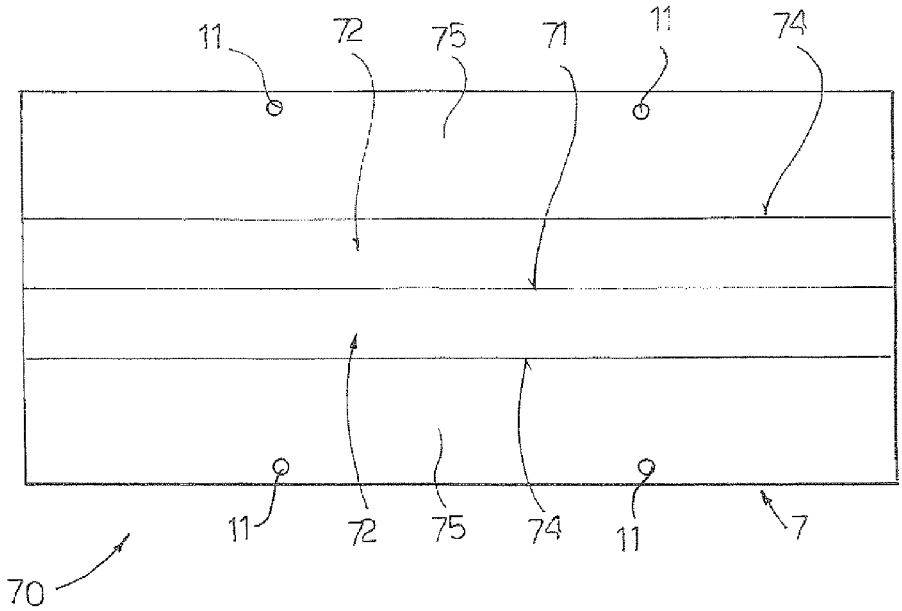
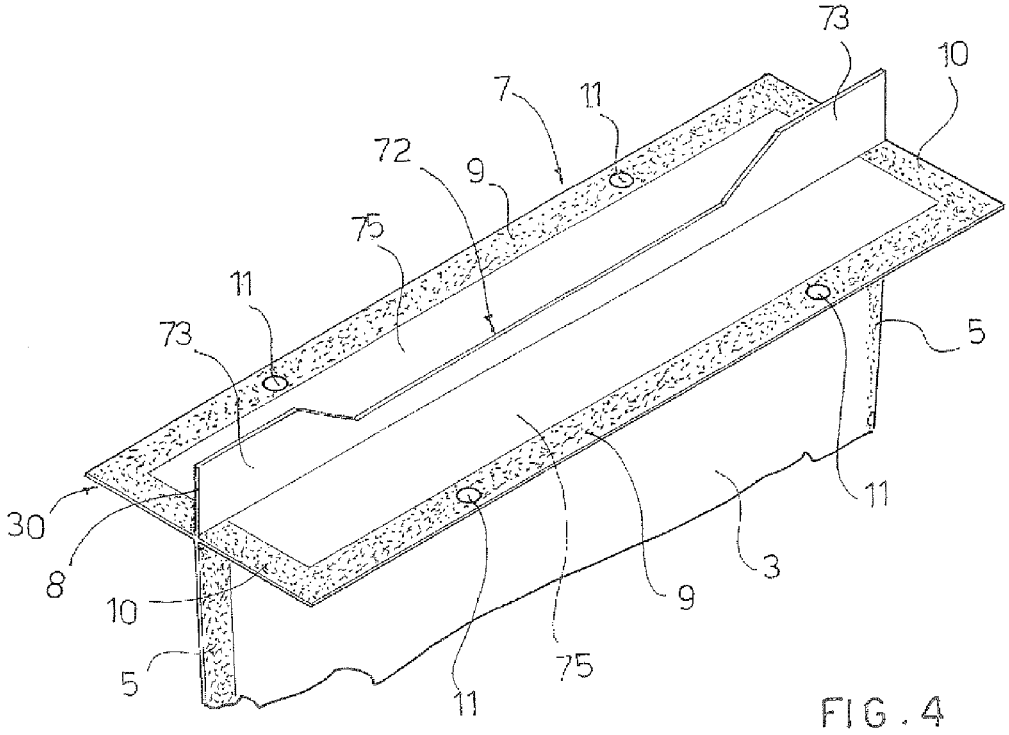
FIG. 4

FIG. 5
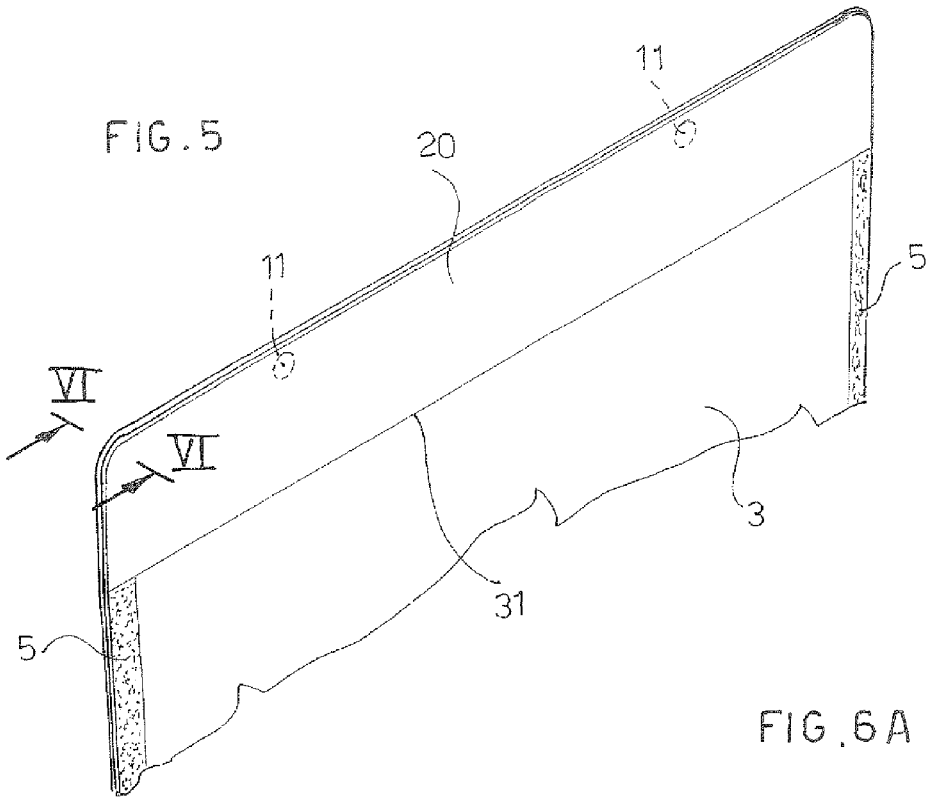
FIG. 6A
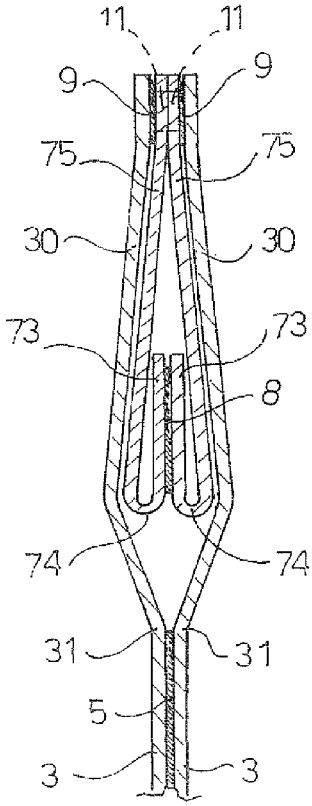
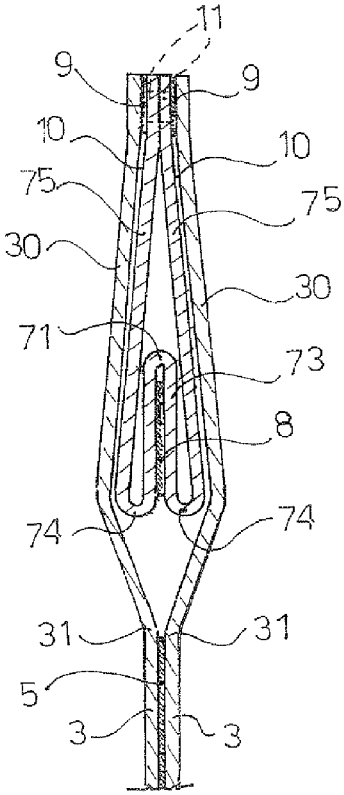
FIG. 6

FIG. 7
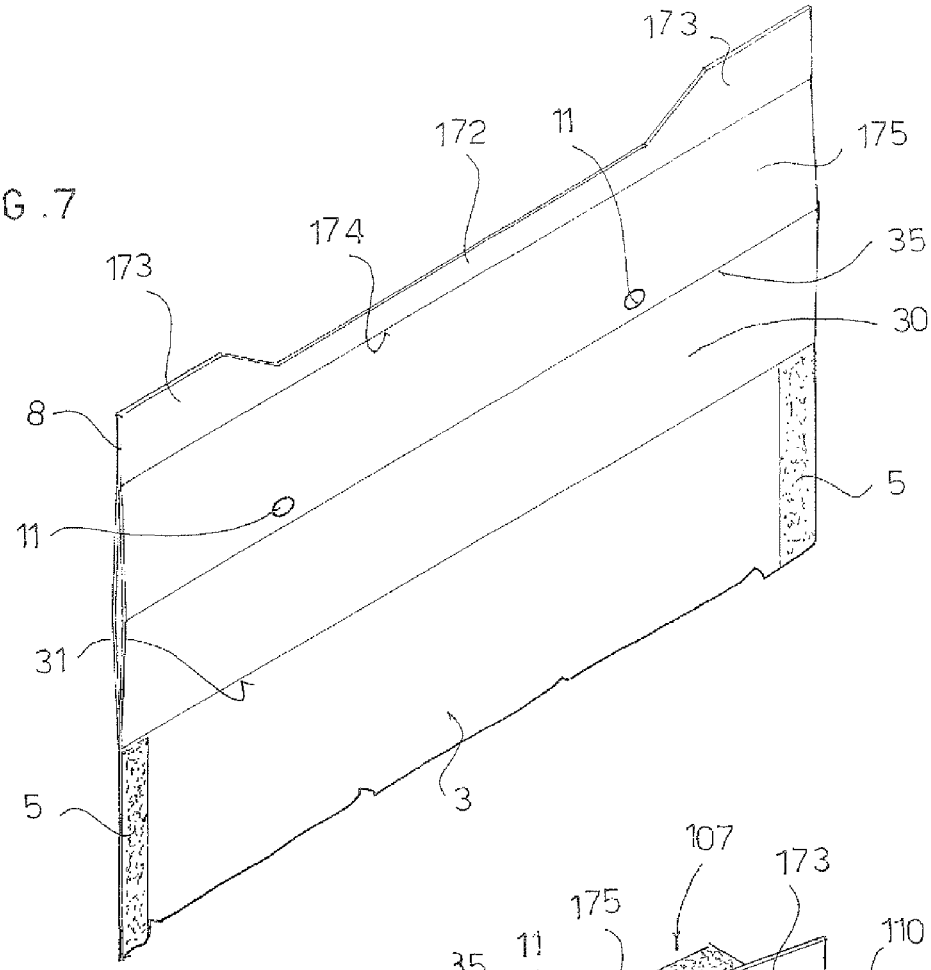
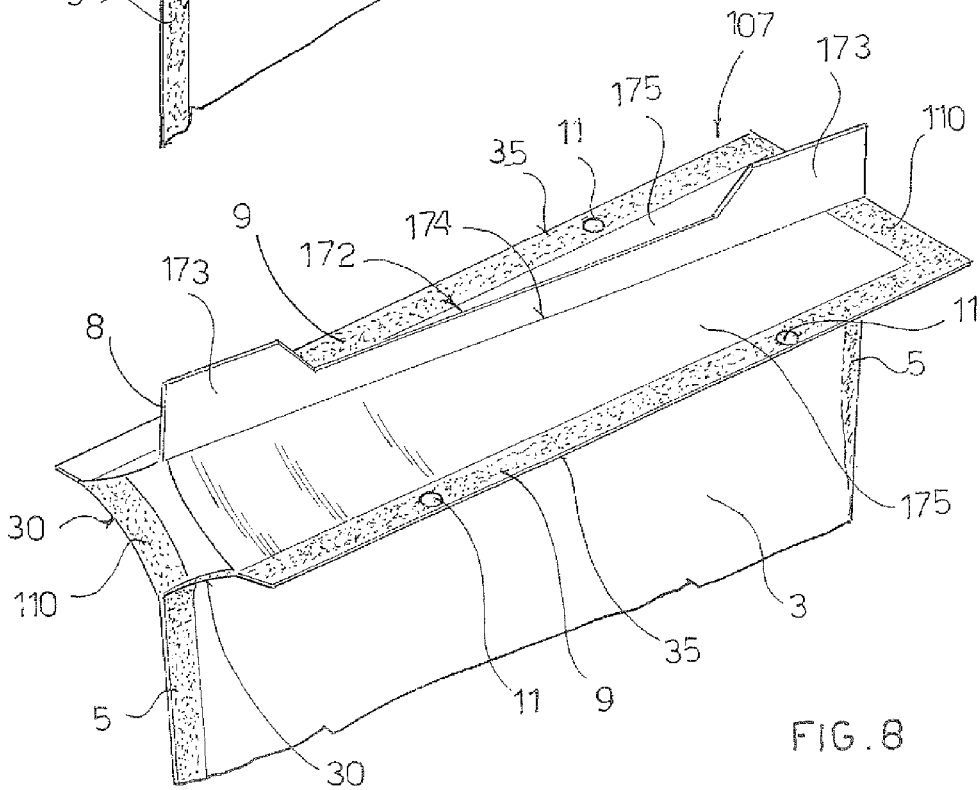
FIG. 8

FIG. 9
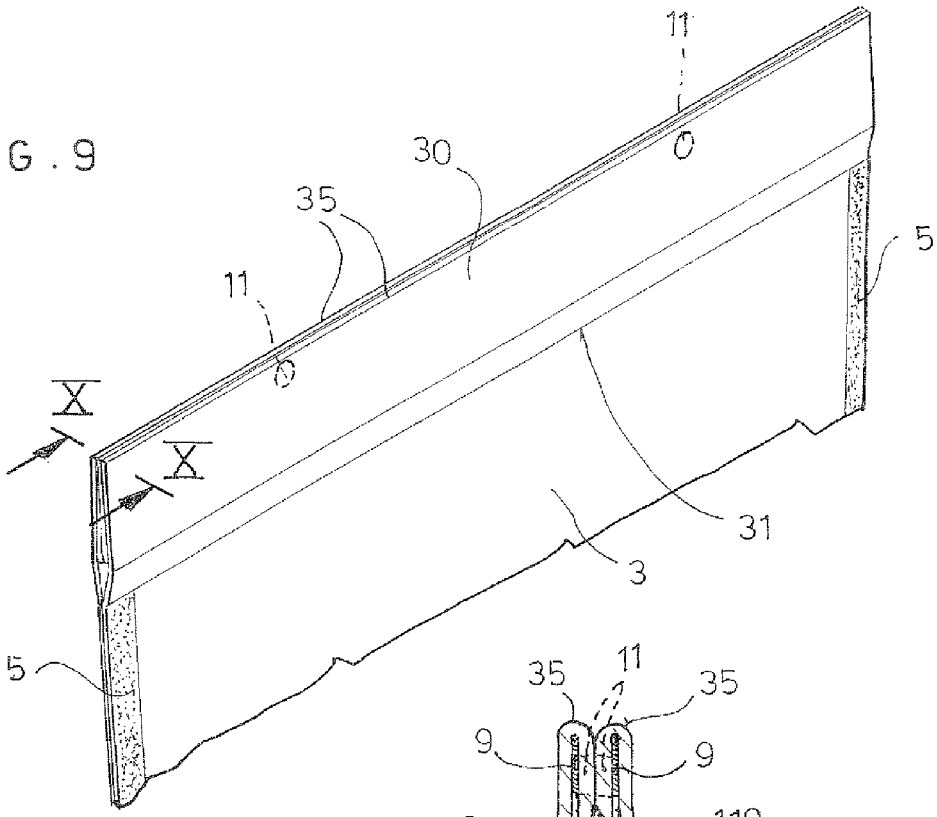
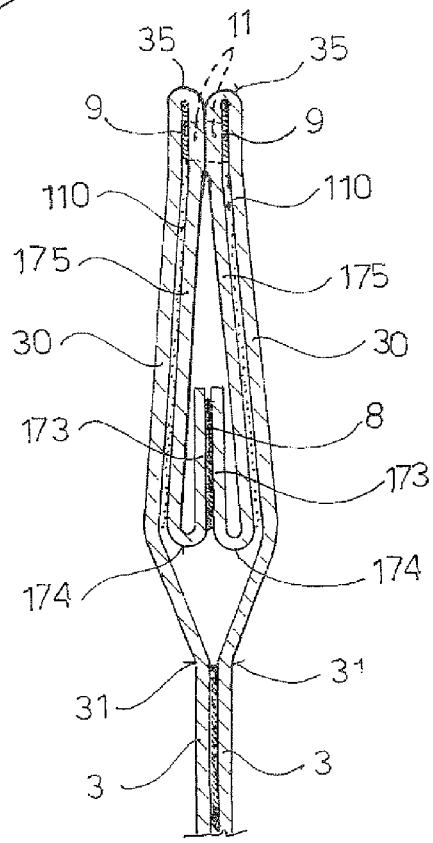
FIG. 10

FIG. 11
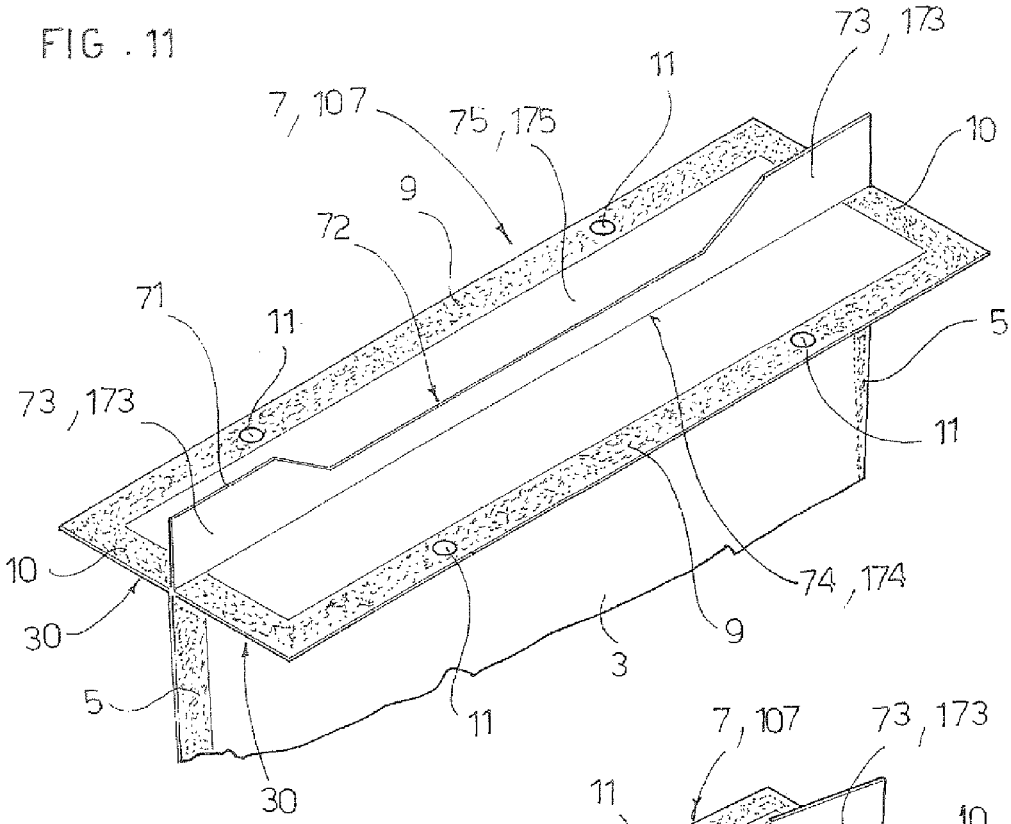
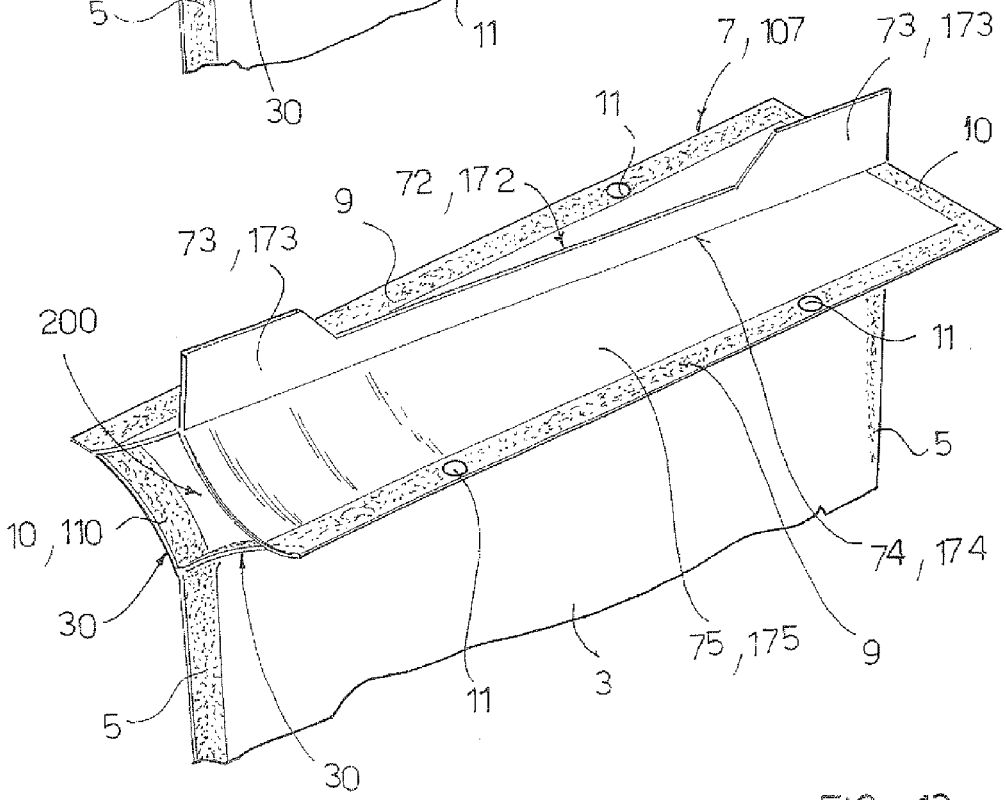
FIG. 12

STAND-UP, EASY-OPEN AND EASY-CLOSE PACKAGE OF FLEXIBLE MATERIAL, PARTICULARLY FOR LIQUID, VISCOUS, PASTY, GRANULAR OR POWDERED PRODUCTS

DESCRIPTION

The present invention relates to a package made of a flexible material for containing liquid, viscous, pasty, granular or powdered products.

Packages of the above type, made of a single- or multilayer flexible material (for example of polyethylene), one or both outer surfaces being heat-sealable, are known to the art and are obtained by successive folding and sealing, normally from a double film.

These packages, also known as stand-up packages in that they are self-supporting when filled with the product, normally have a reinforced supporting base and the two upper end flaps heat-sealed to each other.

For reasons of practicality and of market economy, stand-up packages for liquids are increasingly sought after, for example in the hygiene sector, to contain liquid soaps, shampoos, bubble bath and similar products.

However, said stand-up packages present some drawbacks from the point of view of the opening thereof. In fact, the heat-sealed upper flaps of the package are difficult to separate and the user generally has to cut them with scissors to achieve the opening of the package.

U.S. Pat. No. 3,036,756 discloses a container made of a tubular sheet having an upper closure comprising a top seal flange and lateral seal flanges extending for a portion of the lateral walls of the container. By gripping and pulling the lateral seal flanges, an opening in the top seal flange is obtained.

U.S. Pat. No. 3,738,566 discloses a flexible package, particularly for tobacco, comprising a flat rectangular bag and a closure element in the form of a cap applied over the top of the bag so that narrow marginal portions thereof overlap the lateral top edges of the bag. The bag can be opened by pulling on the upper portion of the cap so as to open the seals provided in said lateral overlapping edges.

Object of the invention is to overcome the above drawbacks by providing a stand-up package that has an easy-open system and does not require the use of scissors or of other tools for removing or for separating the upper flaps of the package, and allows an easy re-closing thanks to the elastic reaction of the material.

Another object of the invention is to provide a package that is practical for the user and that allows an adequate opening to be achieved according to the content of the package.

Another object of the invention is to provide a package that is versatile, adapted to contain different types of products and at the same time simple and cheap to produce.

These objects are achieved by the package according to the invention, which has the characteristics of the appended independent claim 1.

Advantageous embodiments of the invention are described in the dependent claims.

SUMMARY OF THE INVENTION

According to the invention, the package of flexible material for containing liquid, viscous, pasty, granular or powdered products has a supporting base from which rise two opposite side walls joined to the perimeter of the base and joined to each other along the side edges, which can be suitably shaped in order to customise the package or to facilitate the gripping thereof. Each sidewall comprises an upper flap joined thereto by a fold line. The package further comprises:

- a top wall joined peripherally to said upper flaps of the side walls, and
- a peelable closure in at least one portion of the perimeter of the top wall, joined to said upper flaps of the sidewalls.

The peelable closure is destined to be opened so as to create an opening for discharging the product.

On the top wall are provided gripping means adapted to be gripped and raised by the user so as to cause said peelable closure to separate in order to create said opening for discharging the product.

The advantages of the package according to the invention are evident in that it allows a simple, easy and rapid opening by the user.

BRIEF DESCRIPTION OF THE DRAWINGS

Further characteristics of the invention will be made clearer by the detailed description that follows, referring to purely exemplifying and therefore non limiting embodiments thereof illustrated in the appended drawings, in which:

FIG. 3 is a top plan view of the blank from which the top closing wall is obtained;

FIG. 4 is an axonometric view of the top part of the container on which the top wall of FIG. 2 is assembled;

FIG. 5 is an axonometric view of the closed top part of the container according to the first embodiment of the invention;

FIG. 6 is a cross-sectional view taken along the vertical plane of section VI-VI of FIG. 5;

FIG. 6A is a sectional view like FIG. 6, illustrating a variant of the first embodiment of the invention, in which the top wall is made in two portions;

FIG. 7 is an axonometric view of the top part of the package according to a second embodiment of the invention, in a first stage of assembly;

FIG. 8 is an axonometric view of the top part of the package of FIG. 7 in a second stage of assembly;

FIG. 9 is an axonometric view of the closed top part of the package according to the second embodiment of the invention;

FIG. 10 is a cross sectional view taken along the vertical plane of section X-X of FIG. 9;

FIGS. 11 and 12 are two perspective views of the top part of the package according to the invention, illustrating respectively two successive stages of the opening of the package according to the invention.

DETAILED DESCRIPTION OF THE PREFERRED EMBODIMENTS

Figure 1:
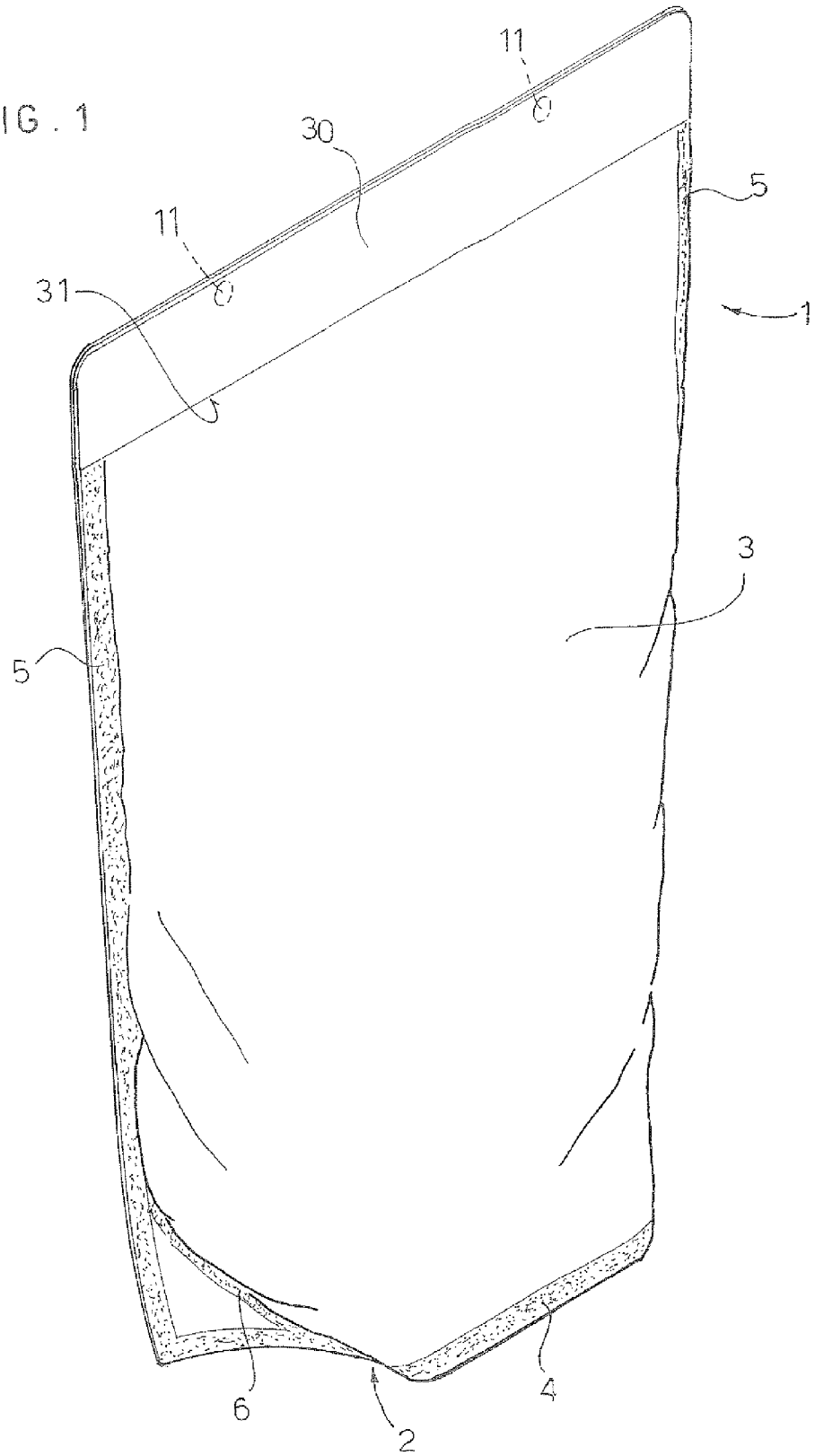
FIG. 1 is an axonometric view of a package according to the invention, illustrated full, closed and in the upright position.

With reference to said figures, and for now in particular to FIG. 1, a package according to the invention has been designated as a whole with the reference numeral 1. It is a package for liquid, viscous or pasty, powdered or granular products, also known as a stand-up package, made of flexible material, with one or more layers heat-sealable on at least one surface. In particular, the package according to the invention call be used to contain personal hygiene products such as shampoo, liquid soaps, bubble bath, detergents, and the like, as well as food products such as drinks, coffee, etc.

The package 1 has a supporting base 2 and two opposite side walls 3, each sealed to a respective half-perimeter 4 of the base 2, and welded to each other at the side edges 5. Each sidewall 3 has a horizontal fold line 31, which defines an upper flap 30.

To allow a widening of the supporting base 2 of the package, each bottom seal 4 is joined to the side edges 5 by means of respective pairs of inclined portions 6. The package 1 thus structured assumes an upwardly tapered shape and can be closed at the top after being filled with the product.

FIGS. 2-6 show a first embodiment of the invention wherein the package 1 has a top wall 7 destined to be disposed on the upper flaps 30 of the sidewalls 3.

As shown in FIG. 3, the top wall 7 is obtained from a rectangular blank 70 which has a longitudinal middle fold line 71 disposed between the two lateral fold lines 74 which define two central longitudinal half-flaps 72 and two side panels 75. The two central half-flaps 72 are folded in a U-shape, superimposed on each other and heat-sealed to each other by means of a heat-seal 8 (FIG. 6) so as to define a single double central flap 72, which rises with respect to the side panels 75. As shown in FIG. 4, the double central flap 72 is cut in its intermediate part so as to forms at its ends, two gripping tongues 73 with a larger surface, adapted to be gripped by the user.

According to a variant, the top wall 7, rather than from a single blank, can be obtained from two rectangular half-blanks, each comprising a side panel 75 and a central half-flap 72. The two half-blanks are coupled together by heat-sealing the central half-flaps 72 along the heat-seal 8 as shown in FIG. 6A.

As shown in FIG. 4, the top wall 7, thus formed, is heat-sealed along its perimeter (9, 10) to the end parts of the upper flaps 30 of the sidewalls 3. At least one of the two heat-seals 10 along the shorter sides of the top part 7 must be a peelable heat-seal, that is of the type that can easily be opened manually by the user. For this purpose, the top wall 7 is made of a material different from that of the sidewalls 3, so as to obtain a peelable heat-seal.

For example, the sidewalls 3 can be made of polyethylene (PE), whilst the top wall 7 can be made of peelable polyethylene. Clearly, if the top part 7 is made of the same heat-sealable material as the sidewalls 3, instead of making a heat-seal a releasable glue or a varnish can be applied.

After the top wall 7 has been applied to the upper flaps 30 of the side walls 3, the upper flaps 30 are folded upwardly along their fold lines 31, closing like a book together with the top wall 7 and enclosing within them the central raised edge 72 of the top wall.

Figure 2:
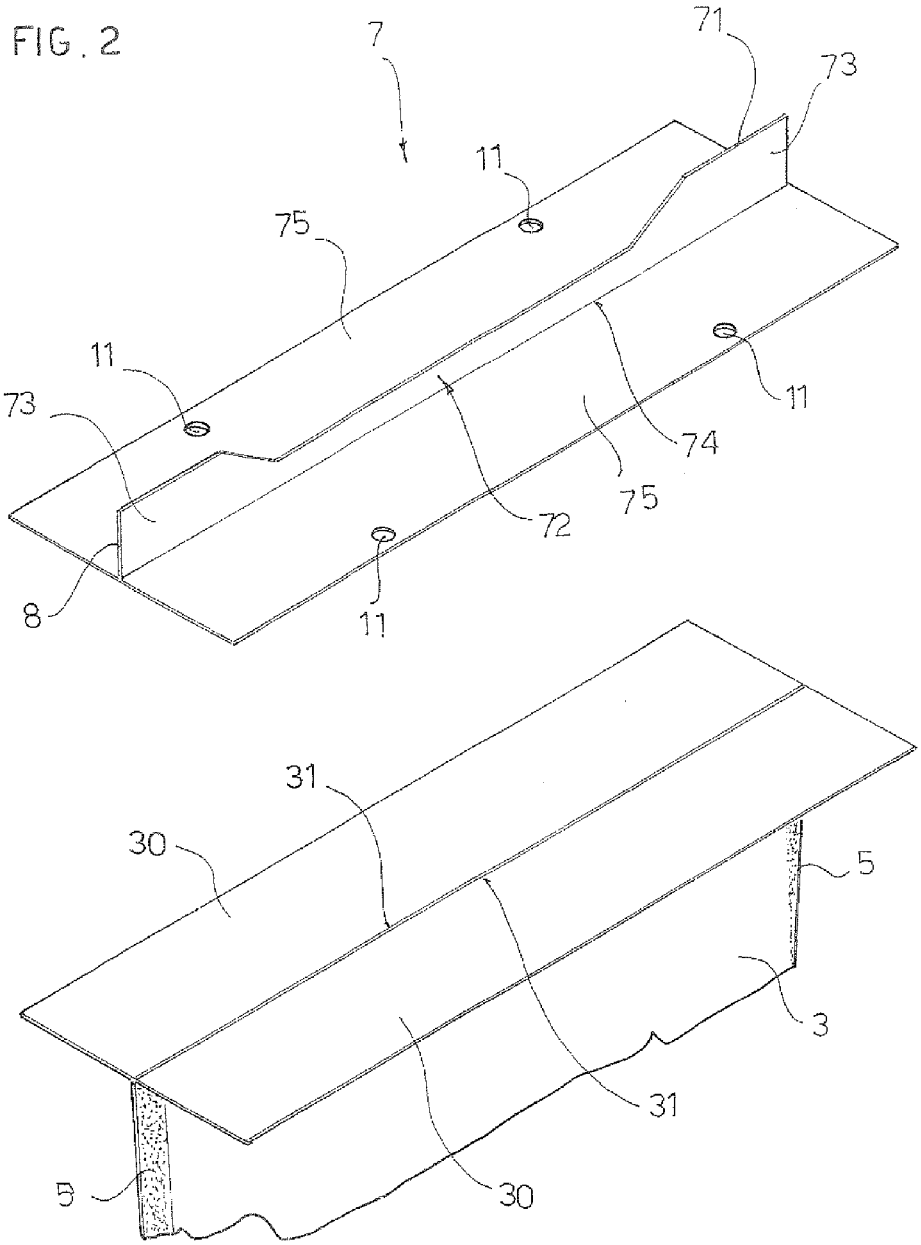
FIG. 2 is an axonometric view illustrating the top part of the package of FIG. 1 and, in an exploded view, a top-closing wall according to a first embodiment of the invention.

It should be noted, as shown in particular in FIGS. 2 and 3, that holes 11 have been punched in the two side panels 75 of the top wall. Therefore, when the side panels 75 of the top wall are placed one on top of the other as shown in FIGS. 5 and 6, the upper ends of the top wall 7 are heat-sealed at the holes 11 at a certain distance from the side edges of the upper flaps 30, whilst the portions of the top wall 7 near the side edges of the upper flaps 30 of the side walls remain free from heat-sealing so that they can be gripped easily. The container 1, as shown in FIG. 1, is then ready to be put on the market.

The particular closure adopted prevents the involuntary separation of the peelable seals, even in the event of pressures exerted on the package, said peelable seals being protected between the flaps 30 and revealing a possible tampering.

With reference to FIGS. 7-10 a second embodiment of the package according to the invention is described, in which like or corresponding elements to those already described are indicated with the same reference numerals and are not described in detail.

In the second embodiment, instead of providing a top part 7 made separately from the sidewalls 3, a top wall 107 obtained directly from the sidewalls 3 is provided.

As shown in FIG. 7, in the second embodiment the sidewalls 3 of the package are made to continue beyond the upper flap 30. That is, the upper flap 30 of each sidewall continues in a closing panel 175, starting from the fold line 35. The panel 175 has the same surface area as the panel 75 of the top wall 7 of the first embodiment.

Each closing panel 175 ends with an end flap 172 joined thereto by means of a fold line 174. The two end flaps 172 are brought together and heat-sealed to each other, by means of a heat-seal 8 (FIG. 10), so as to obtain a double upper end flap 172. A cut is then made in the intermediate part of the double upper end flap 172 so as to create two gripping tongues 173 at the side ends thereof.

At this point, as shown in FIG. 8, the double upper end flap 172 is lowered, so that the panels 175 and the flaps 30 fold along the intermediate fold line 35 and are disposed substantially at right angles with respect to the sidewall 3. It should be noted that the panels 175 and the heat-sealed upper flaps 172 form a rectangular top wall 107 entirely similar to the top wall 7 of the first embodiment. Respective strips of heat-sealing 9 can then be made along the fold lines 35, that is along the longer sides of the top wall 107, to have a configuration similar to that of the previous embodiment. However, in this case the seals 9 can be omitted since the flaps 30 are extensions of the sidewalls 3.

On the edges of the shorter sides of the top wall 107, between the flaps 30 and the panels 175, on the other hand, a releasable glue or a varnish 110 is applied so as to obtain a peelable closure. In fact, if the entire sidewall is made of polyethylene, a direct heat-sealing of polyethylene with polyethylene cannot be performed at the shorter side of the top wall 107 since this would lead to a permanent, non-peelable closure.

Lastly, as shown in FIGS. 9 and 10, the edges 30 and the panels 175 are closed like a book, enclosing within them the end flap 172 with the gripping tongues 173. In this case also, the holes 11 that serve for the heat-sealing, as described in the first embodiment, have been punched in the side panels 175 of the top wall. Finally, a final package 1, like that illustrated in FIG. 1 and entirely similar to the package according to the first embodiment of the invention, is obtained.

To open the package 1, the user grips the two flaps 30 superimposed on the panels (75, 175) and pulls them apart from each other, so as to break the points of heat-sealing in the holes 11, as shown in FIG. 11. Then, as shown in FIG. 12, the user grips a gripping tongue (73, 173) and lifts it, causing the peelable closure (10, 110) to break, so as to create an opening 200 adapted to allow the discharge of the product.

Of course, depending on the product the package has to contain, the size of the abovementioned opening 200 can be adjusted by varying the length of the edges 30, that is, of the abovementioned peelable heat-seals (10, 110).

Furthermore, it must be considered that the peelable closure (10, 110) creates an opening 200 which can be re-closed and re-opened time and again. The use of suitable materials with suitable elasticity can be decisive for obtaining a good re-closure. In this manner, if the contents of the package 1 are partially consumed, the opening 200 can be closed again, protecting the product remaining inside the package.

From what has been described the advantages of the solution proposed by the invention are clear, although it must not be considered confined to what has been described and illustrated above, but solely to the content of the claims that follow.

The invention claimed is:

1. A package (1) of stand-up type made of flexible material for containing any of liquid, viscous, pasty, granular or powdered products, comprising:

a supporting base (2);

two opposite side walls (3) rising from said supporting base, joined to a perimeter of said base (2) and joined to each other along side edges (5) of said side walls (3), each of said side walls (3) comprising an upper flap (30) joined thereto by a fold line (31);

a top wall (7, 107) substantially rectangular in shape joined peripherally to said upper flaps (30) of the side walls;

a peelable closure (10, 110) in at least one of two shorter sides of the top wall, said peelable closure (10, 110) being adapted to be opened so as to create an opening (200) for discharging the product in said at least one of the two shorter sides of the top wall; and gripping means (73, 173) on said top wall (7, 107), adapted to be gripped and raised by a user so as to cause a separation of said peelable closure (10, 110) to create said opening (200) for discharging the product, wherein said upper flaps (30) of the side walls joined to the top wall (7, 107) are superimposed on each other and joined to each other so as to close within them the gripping means (73, 173).

2. The package (1) according to claim 1, wherein said peelable closure (10, 110) is adapted to be opened and dosed multiple times to allow successive uses of the product contained in the package.

3. The package (1) according to claim 1, wherein said top wall (7) is made of a material different from that of the side walls (3), and wherein said peelable closure (10) between said top wall (7) and said upper flaps (30) of the side walls is obtained by heat-sealing of differing materials.

4. The package (1) according to claim 1, wherein said top wall (107) is made of a same material as the side walls (3), and wherein said peelable closure (110) between said top wall (107) and said upper flaps (30) of the side walls is obtained by interposing one of a releasable glue or a varnish.

5. The package (1) according to claim 1, wherein said top wall (7, 107) comprises:

two panels (75, 175) superimposed on respective upper flaps (30) of the side walls, and a central flap (72, 172) disposed between the two panels and whereon said gripping means (73, 173) are provided.

6. The package (1) according to claim 5, wherein said gripping means (73, 173) are two tongues disposed at ends of said central flap (72, 172).

7. The package (1) according to claim 1, wherein said top wall (7) is made from at least one blank (7) separated from said side walls (3).

8. The package (1) according to claim 1, wherein said top wall (107) is formed by means of an extension of said side walls, each extension comprising:

a panel (175) connected, by means of a fold line (35) to a respective upper flap (30) of a respective side wall, and an end flap (172) connected, by means of a fold line (174), to the panel (175), and wherein the two end flaps (172) are heat-sealed to each other so as to create said gripping means (173).

9. The package (1) according to claim 1, wherein said upper flaps (30) of the side walls joined to the top wall (7, 107) are joined by heat-sealing at holes (11) punched in said top wall (7; 07).

10. A package (1) of stand-up type made of flexible material for containing any of liquid, viscous, pasty, granular or powdered products, comprising:

a supporting base (2);

two opposite side walls (3) rising from said supporting base, joined to a perimeter of said base (2) and joined to each other along side edges (5) of said side walls (3), a top of each of said side walls (3) connecting to an upper flap (30) delimited by a fold line (31);

a top wall (7, 107) substantially rectangular in shape, two longer sides of said top wall joined to two longer sides of said upper flaps (30) of the side walls;

a peelable closure (10, 110) along a shorter side of the top wall to releasably seal said shorter side against a short edge formed by two adjacent shorter sides of the side walls, said shorter side of the top wall and said short edge being reversibly separable at the peelable closure (10, 110) so as, in use by a user, to create an opening (200) at said short edge for discharging the product, the peelable closure being limited to the shorter side of the top wall and said short edge; and gripping means (73, 173) on said top wall (7, 107), configured to be gripped and raised by a user so as to cause the separation at said peelable closure (10, 110) to form said opening (200)

wherein respective edges of the two longer sides of the top wall are joined to each other so that the two longer sides of the top wall face each other and form an enclosure therebetween, the gripping means (73, 173) being located within the enclosure.

11. The package (1) according to claim 10, wherein the longer sides of said top wall are joined to the longer sides of said upper flaps (30) of the side walls by a non-peelable seal.

12. The package (1) according to claim 10, wherein said top wall is formed from extensions of the longer sides of said upper flaps (30), said extensions folded over edges of the longer sides of said upper flaps (30) to form the longer sides of the top wall, and respective ends of the extensions being joined together to form the gripping means.

13. The package (1) according to claim 10, wherein, in use, only the peelable closure of the short edge and the shorter side of the top wall is separable by the user.

* * * * *